US007552725B2

(12) United States Patent
Chen et al.

(10) Patent No.: US 7,552,725 B2
(45) Date of Patent: Jun. 30, 2009

(54) CUTTING ANGLE ADJUSTMENT DEVICE FOR A STONE CUTTER

(76) Inventors: Yuehting Chen, P.O. Box 697, Fongyuan City 420, Taichung County (TW) 420; Wen-Hai Tsao, P.O. Box 697, Fongyuan City 420, Taichung County (TW) 420

( * ) Notice: Subject to any disclaimer, the term of this patent is extended or adjusted under 35 U.S.C. 154(b) by 0 days.

(21) Appl. No.: 11/707,931

(22) Filed: Feb. 20, 2007

(65) Prior Publication Data

US 2008/0173292 A1 Jul. 24, 2008

(30) Foreign Application Priority Data

Jan. 19, 2007 (TW) ..... 96201050 U

(51) Int. Cl.
*B28D 1/04* (2006.01)

(52) U.S. Cl. ..... 125/13.01; 125/13.03; 83/581; 83/477; 83/477.2; 83/663

(58) Field of Classification Search ..... 83/581, 83/651, 665, 663, 676, 485, 483, 486, 473, 83/472, 477, 477.2, 471.2, 471.3, 468.3, 83/468.4; 125/12, 17, 13.01, 13.03, 16.01, 125/16.04, 20

See application file for complete search history.

(56) References Cited

U.S. PATENT DOCUMENTS 4,428,159 A * 1/1984 Sigetich et al. ..... 451/213
5,746,193 A * 5/1998 Swan ..... 125/13.03
6,272,961 B1 * 8/2001 Lee ..... 83/581
6,276,990 B1 * 8/2001 Greenland ..... 451/11
6,637,424 B1 * 10/2003 Fuhrman et al. ..... 125/35
6,679,244 B1 * 1/2004 Tsao ..... 125/13.01
6,752,140 B1 * 6/2004 Fuhrman et al. ..... 125/13.03
6,883,511 B1 * 4/2005 Tsao ..... 125/13.03
6,932,075 B1 * 8/2005 Tsao ..... 125/13.01
6,978,707 B2 * 12/2005 Lee ..... 83/581
7,066,627 B1 * 6/2006 Chen ..... 362/259
7,140,361 B1 * 11/2006 Chao-Huan ..... 125/13.01

* cited by examiner

*Primary Examiner*—Boyer D Ashley
*Assistant Examiner*—Omar Flores-Sánchez

(57) ABSTRACT

A cutting angle adjustment device for a stone cutter includes a rectangular water sink, an inverse L-shaped support arm anchored to a lateral side of the sink, a stone cutter adjustably connected to the support arm through a coupling assembly, a pair of guide rods parallel disposed to a pair of rack on front and rear ends of the sink, a platform having two rotors aligned to each other and symmetrically arranged and slidably engaged with the inner sides of the guide rods, a vertical cutting slit and a slant cutting slit parallel formed in the upper surface thereof. Thereby, a saw blade is adjusted vertically and/or slantly relative to the top of the platform to conduct a vertical or slant cutting and a shallow or deep cutting of the workpiece.

2 Claims, 6 Drawing Sheets

CUTTING ANGLE ADJUSTMENT DEVICE FOR A STONE CUTTER

BACKGROUND OF THE INVENTION

The present invention relates to the cutters and more particularly to a cutting angle adjustment device for a stone cutter which allows to cut a workpiece at an desired angle and height.

Conventional stone cutter has its blade perpendicular to the platform so as to cut the edge of a working piece straightly. If desiring to cut the workpiece at its slant edge, the worker has to cut it straightly, and then to put the workpiece obliquely so as to cut it at a slant edge, causing a tedious cutting. TW Pat. No. 94207355, entitled "Saw blade angular adjustment device for a metal and wood cutting machine" and the U.S. application Ser. No. 11/138,337 disclose that a pair of axle plates are used to position a displacement seat and to urge the cutting machine to move toward a correct slant angle. Due to this cutting machine is of small size, limiting cutting range.

TW Pat. No. 92221201, entitled "Blade angle adjustment device for a stone cutter" and U.S. Pat. No. 6,932,075 disclose that an axle arm are used to support a stone cutter which is capable of adjusting the slant angle on the axle arm to slantwise cut a workpiece. Then a platform is slidable and has a vertical and a slant cutting groove. When having a vertical cutting, the blade can deeply enter into the cutting groove. If desiring to have a slant cutting, the platform is slid for enabling the stone cutter to be adjusted toward a slant angle on the axle arm. Then the platform is moved back to its original position to begin a slant cutting. The slant angle is always at 45 degrees, making errors and having a tedious cutting if having a shallow cutting.

SUMMARY OF THE PRESENT INVENTION

The present invention has a main object to provide a cutting angle adjustment device for a stone cutter which is easily to be adjusted toward a slant angle for cutting a slant edge of the workpiece.

Another object of the present invention is to provide a cutting angle adjustment device for a stone cutter which can conduct shallow and deep cuttings. Also, the cutting result at vertical and slant angles are always accurate.

Accordingly the cutting angle adjustment device for a stone cutter comprises generally:

a water sink supported at front and rear ends by a pair racks, a pair of guide rods parallel disposed on the racks for sliding a platform thereon, a support arm standing on the rack with a central hole and an arcuate slot on a top thereof for connecting a coupling assembly which is centered on the central hole and adjusted the slant angle along the arcuate slot, the coupling assembly having one end axially connected to the support arm and other end connected to the stone cutter, an adjustable plate pivoted pivotally connected to the top thereof, wherein the adjustable plate has one end connected to the top of the stone cutter and an adjustable slot in its body, the stone cutter including a motor, a saw blade and a housing on outside thereof, the platform having two rollers aligned to each other and located on the underside thereof for slidably engaging with the guide rods, a vertical cutting groove and a slant cutting groove parallel formed in the top thereof, thereby, the stone cutter enables to make longitudinal inclination upon the support arm and horizontal inclination upon the adjustable plate to conduct a shallow or a deep cutting at a certain angle.

The present invention will become more fully understood by reference to the following detailed description thereof when read in conjunction with the attached drawings.

DETAILED DESCRIPTION OF THE PREFERRED EMBODIMENT

Figure 1:
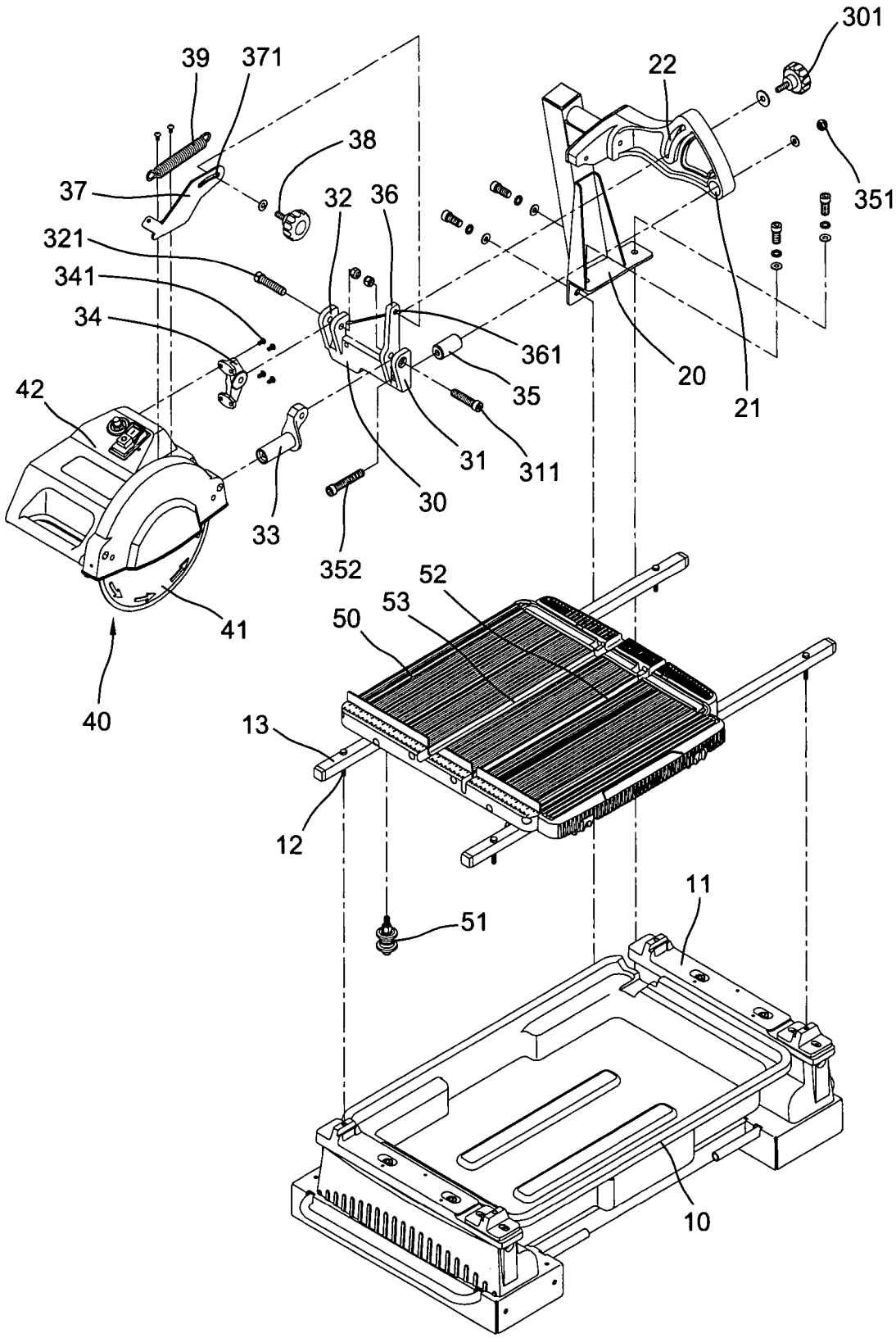
FIG. 1 is an exploded perspective view of the preferred embodiment of the present invention.
Figure 2:
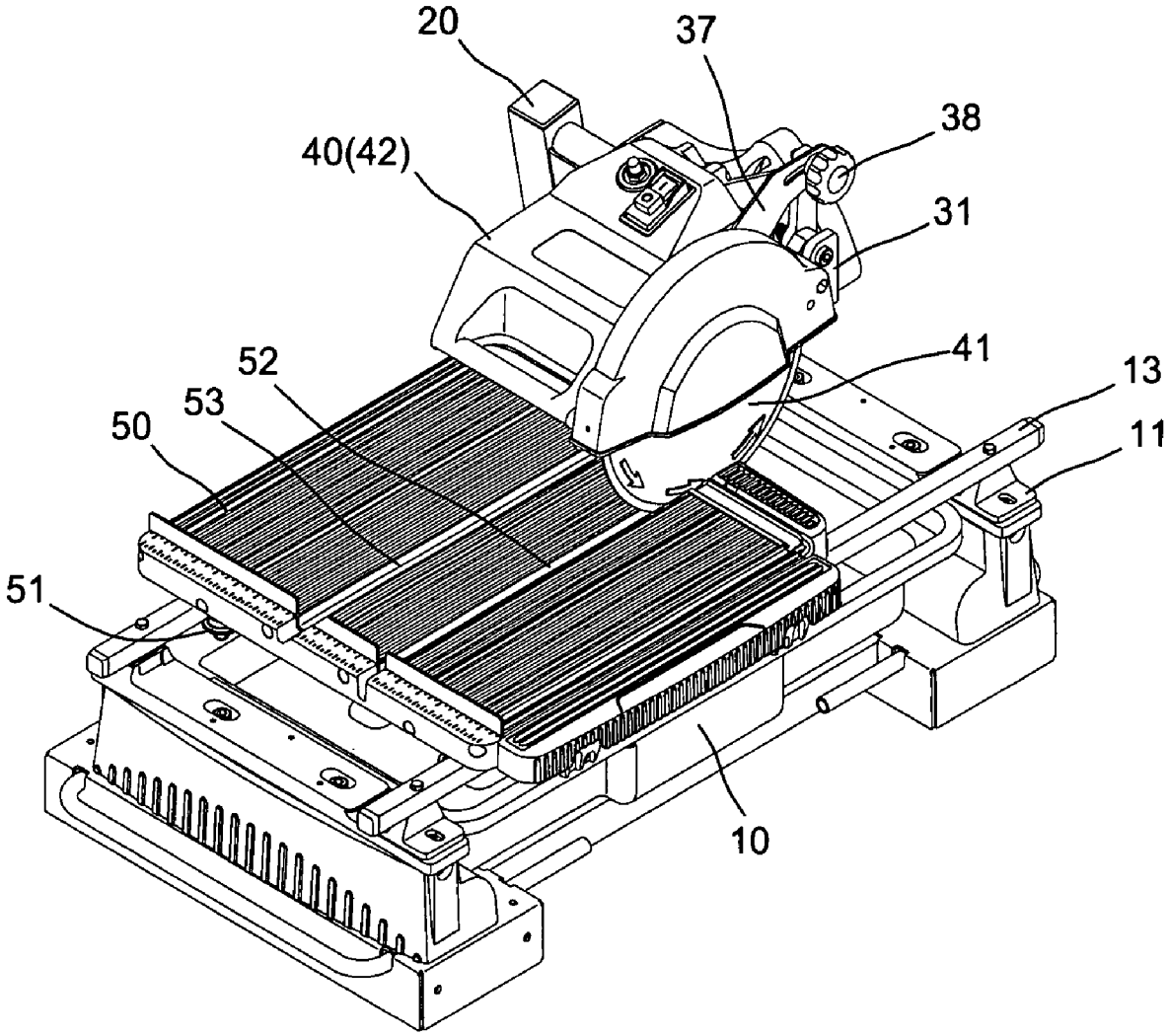
FIG. 2 is a perspective view to show the assembly of FIG. 1.
Figure 3:
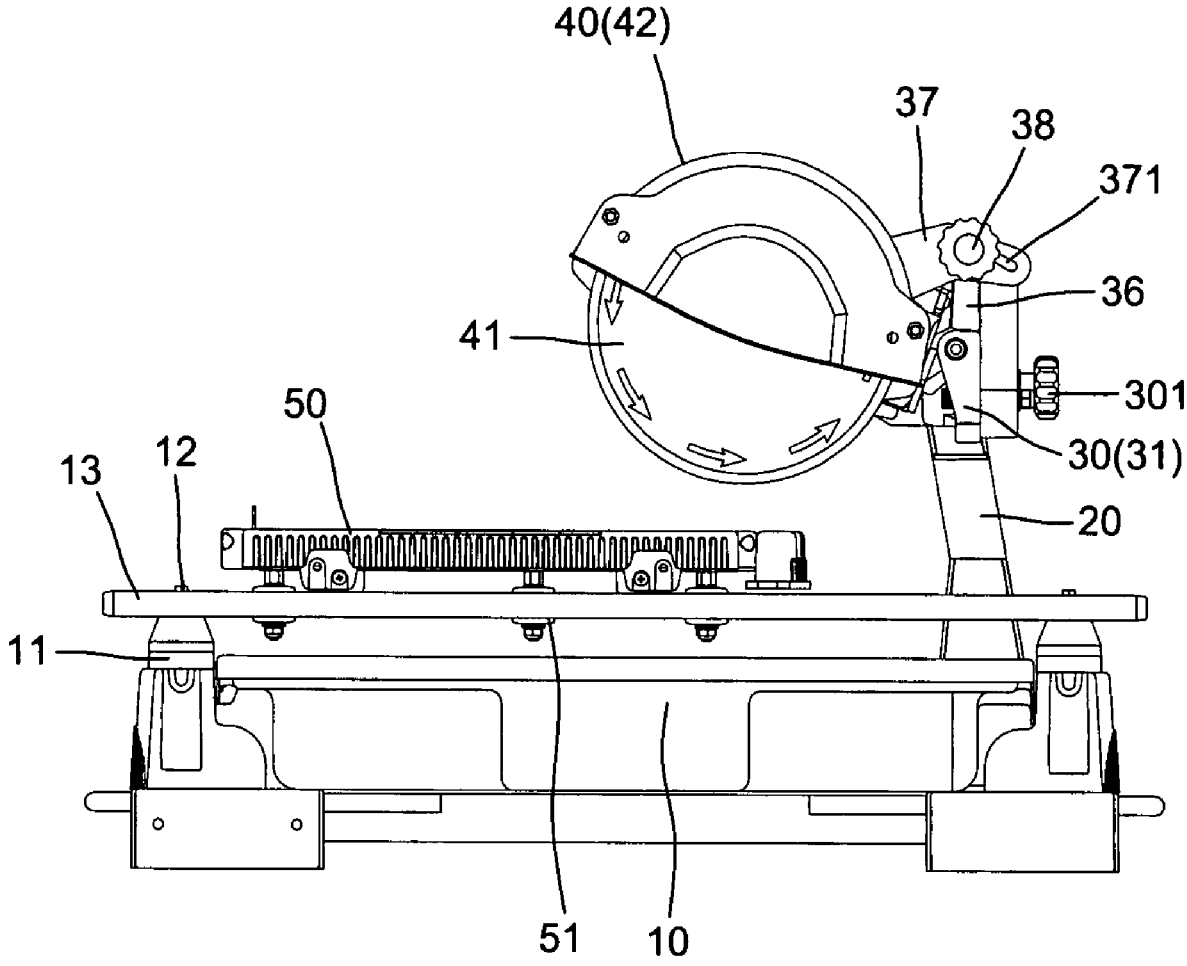
FIG. 3 is a plane view to show that the stone cutter is raised toward a lateral angle.

With reference to the drawings and initiated from FIGS. 1, 2 and 3, the cutting angle adjustment device for a stone cutter comprises generally a water sink 10, a support arm 20, a coupling assembly 30, a stone cutter 40 and a platform 50.

The water sink 10 is of a rectangular basin having front and rear ends supported by a pair of racks respectively, the water inside the sink 10 is to mix the sawdust or the sink 10 keeps no water to directly collect the sawdust, a pair of guide rods are parallel disposed upon the racks 11 and secured by screws 12.

The support arm 20 is secured to a lateral wall of the sink 10 abutting to the front end thereof and has an inverse L-shaped body, a central hole 21 (circular hole) in a triangular end of the transverse portion of the inverse L-shaped body and a vertical arcuate slot 22 nearby the central hole 21.

The coupling assembly 30 is disposed between the support arm 20 and the stone cutter 40 and has first and second U-shaped coupling means 31 and 32 at two ends thereof respectively, wherein the first U-shaped coupling means 31 has an upright projection 36 on the inner side thereof, an axle connection tube 33 with a protrusion on front end thereof is pivotally connected to the first U-shaped coupling means 31 by a bolt 311, the other end of the axle connection tube 33 is connected to the housing 42 of the stone cutter 40, a positioning member 34 includes a lower end pivotally connected to the second U-shaped coupling means 32 by a bolt 321 and an upper end connected to the housing 42 by screws 341, a central tube 35 is connected between a screw hole (not shown) in the lower portion of the rear end surface of the first U-shaped coupling means 31 and the central hole 21 of the support arm 20 by a bolt 352 and a nut 351, the upright projection 36 with a front end surface and a rear end surface, on the upper portion of the rear end surface of the upright projection 36 is provided with another screw hole (not shown) which is pivotally connected to a first hand bolt 301 through the arcuate slot 22 of the support arm 20, an adjustable plate 37 with an transverse adjustable slot 371 is engaged with the screw hole 361 which passes through the upright projection 36 and is releasably secured by a second hand bolt 38 which passes through the adjustable slot 371 of the adjustable plate 37, the other end of the adjustable plate 37 is connected to a top of the housing 42 of the stone cutter 40, a spring 39 has one end connected to the upright projection 36 and the other end connected to the rear end of the adjustable plate 37 for providing the resilient force to the stone cutter 40.

The stone cutter 40 includes a disc saw 41, a housing 42 and a motor (not shown) inside the housing 42.

The platform 50 has a rectangular body, two rotors 51 aligned to each other and symmetrically arranged on underside thereof and rotatably sliding on the inner sides of the guide rods 13, a vertical cutting slit 52 and a slant cutting slit 53 parallel formed in the upper surface thereof.

Figure 4:
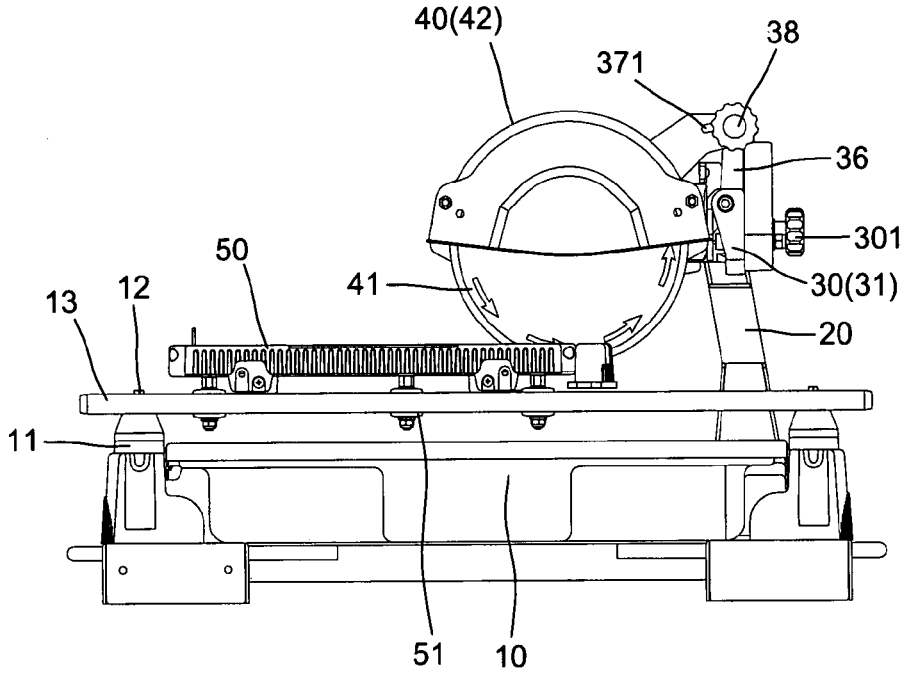
FIG. 4 is a plane view looking from the right side of the stone cutter.
Figure 5:
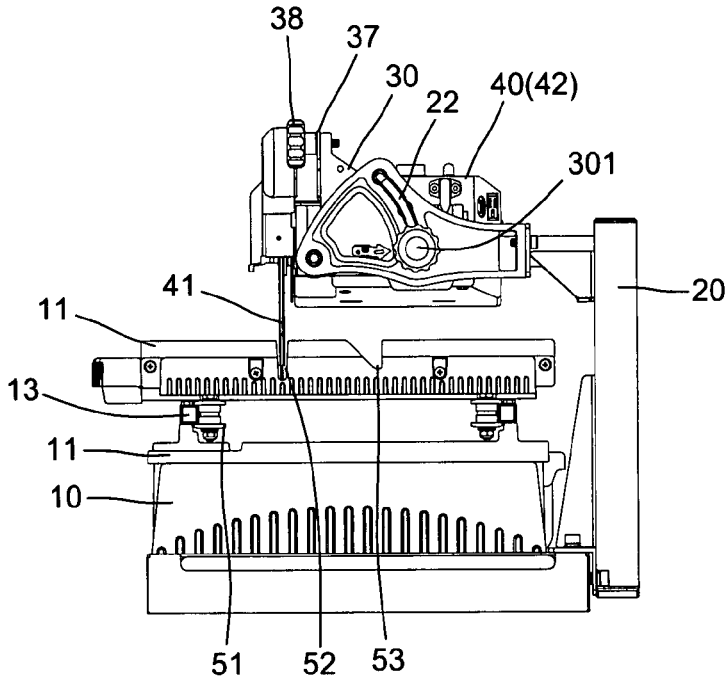
FIG. 5 is a plane view looking from the front side.
Figure 6:
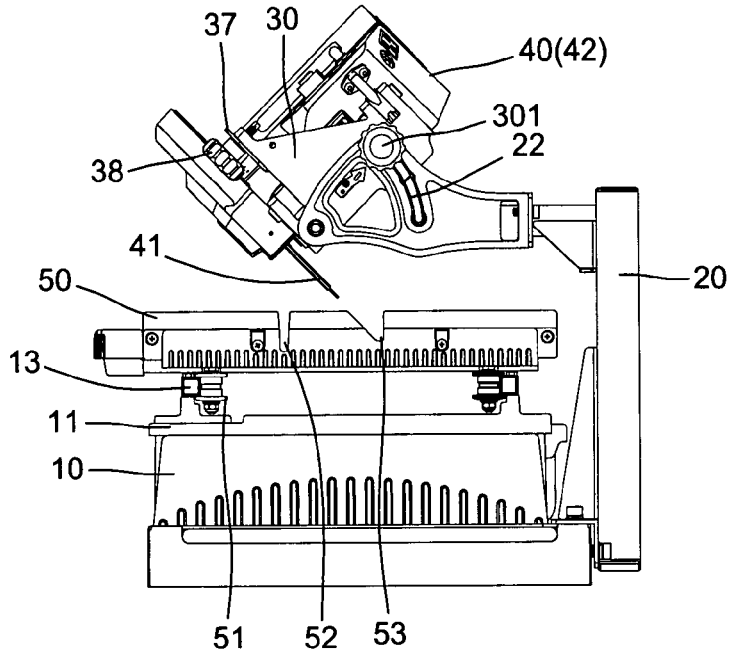
FIG. 6 is a plane view of FIG. 5 where the stone cutter is adjusted toward a slant angle.
Figure 7:
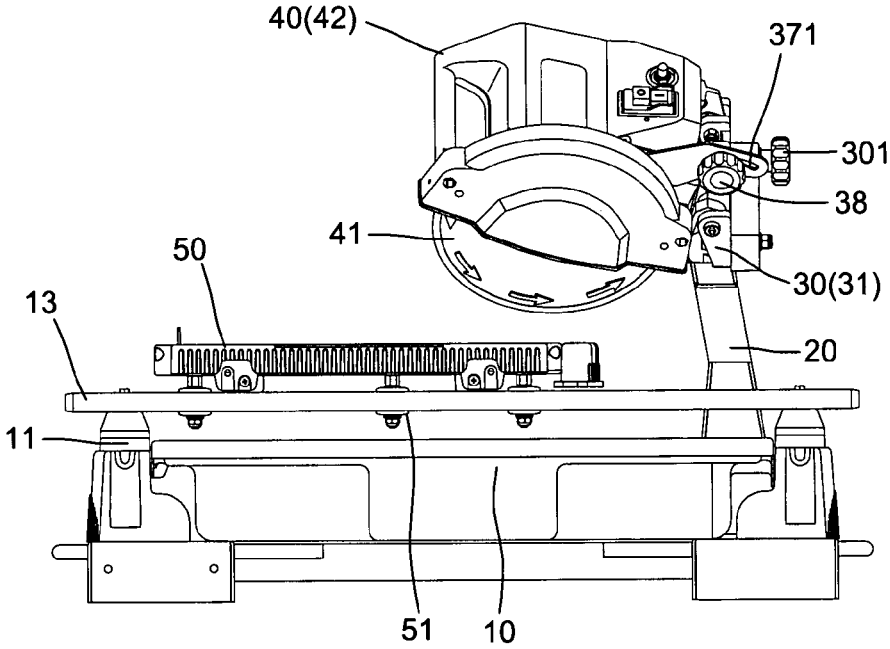
FIG. 7 is a plane view looking from the right side where the stone cutter is suspended in the air.
Figure 8:
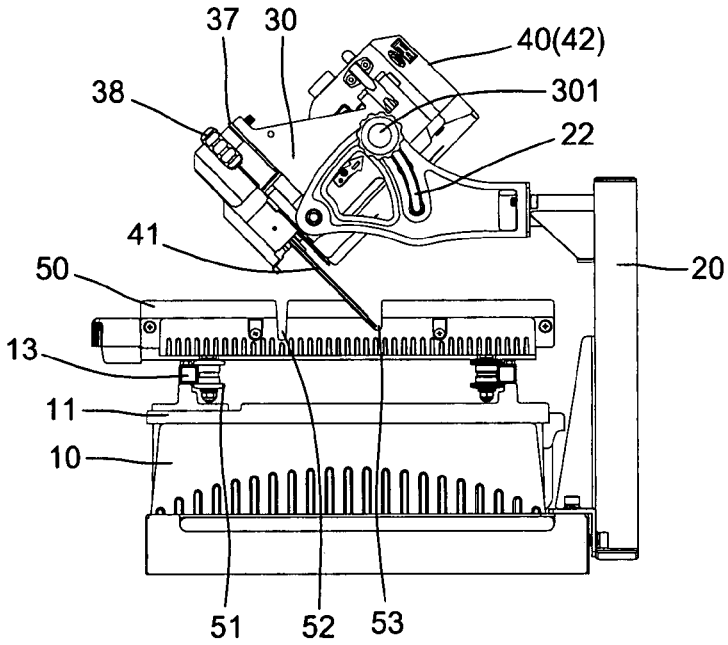
FIG. 8 is a plane view looking from the front side where the stone cutter is conducting a slant cutting.
Figure 9:
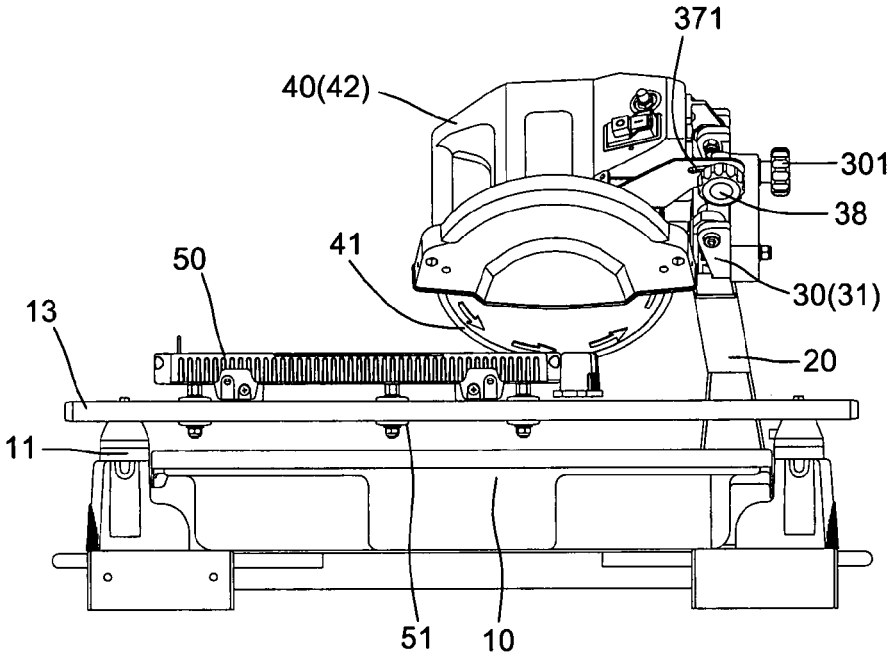
FIG. 9 is a plane view of FIG. 8 looking from the right side.

Referring to FIGS. 3, 4 and 5, before conducting a vertical cutting, the second hand bolt 38 is unfasten to release the adjustable plate 37 until it slides toward the front end of the slot 371, then the second hand bolt 38 is fastened to fix the adjustable plate 37, the blade 41 of the stone cutter 40 automatically inserts into the vertical cutting slit 52. Then the platform 50 slides to meet the downward movement of the stone cutter 40 until the saw blade 41 is engaged into the vertical cutting groove 51, finishing the adjustment. And then the motor is started to have a cutting process. When conducting a slant cutting process, the first hand bolt 301 is unfastened to slide within the arcuate slot 22 centered on the central hole 21, thus slanting the coupling assembly 30. Thereafter, the hand first bolt 301 is fastened till it reaches toward the top of the arcuate slot 22. While the slant angle of the saw blade 41 is exactly at 45 degrees relative to the upper surface of the platform 50 and the saw blade 41 enters into the slant cutting groove 53, the adjustment for slant cutting is finished.

The stone cutter can also conduct a shallow cutting. For example, the second hand bolt 38 is positioned at a middle portion of the slot 371 of the adjustable plate 37 so that the saw blade 41 will not deeply enter into the slant cutting groove 53 but is still at 45 degrees Therefore, the user can conduct a shallow cutting of the workpiece.

The present invention discards the disadvantages of the prior art such as the single cutting groove or changing the slant angle when conducting a shallow cutting. The present invention may obtain a shallow or deep cutting at the slant angle. Besides, the angular adjustment is to be carried out even if the platform 50 is not moved off. So it is very convenient.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

We claim:

1. A cutting angle adjustment device for stone cutter comprising:

a water sink which is a rectangular basin having front and rear ends supported by a pair of racks respectively;

a pair of guide rods parallel disposed on the racks and secured by screws;

an inverse L-shaped support arm secured to a lateral wall of the water sink abutting to the front end thereof, a circular central hole in a triangular end of a transverse portion of the inverse L-shaped support arm and a vertical arcuate slot nearby the central hole;

a stone cutter having a housing, a motor in the housing and a saw blade under the housing;

a coupling assembly disposed between said support arm and said stone cutter and having first and second U-shaped coupling means on two ends thereof respectively, wherein the first U-shaped coupling means has an upright projection on inner portion thereof, an axle connection tube with a protrusion on front end thereof is pivotally connected to the first U-shaped coupling means by a bolt, the other end of the axle connection tube is connected to the housing of said stone cutter, a positioning member includes a lower end pivotally connected to the second U-shaped coupling means by a bolt and an upper end connected to the housing by screws, a central tube is connected between a screw hole in a lower portion of the rear end surface of the first U-shaped coupling means and the central hole of said support arm by a bolt and a nut; said upright projection with a front end surface and a rear end surface, on the upper portion of the rear end surface of the upright projection is provided with another screw hole which is pivotally connected to a first hand bolt through the vertical arcuate slot of said support arm, an adjustable plate with a transverse adjustable slot is engaged with the screw hole which passes through the upright projection and is releasably secured by a second hand bolt which passes through the adjustable slot of the adjustable plate, the other end of the adjustable plate is connected to a top of said housing, a spring has one end connected to the upright projection and the other end connected to the rear end of said adjustable plate;

a platform has a rectangular body is slidably disposed on the pair of guide rods, two rotors aligned to each other and symmetrically arranged on underside thereof and rotatably sliding on the inner sides of the guide rods, a vertical cutting slit and a slant cutting slit parallel formed in upper surface of the platform;

whereby, can adjust vertical position and the slant angle for the stone cutter to conduct a vertical and slant cutting.

2. The cutting angle adjustment device as recited in claim 1, wherein said stone cutter is able to conduct a shallow and deep cutting after being adjusted toward the vertical position of the saw blade.

* * * * *